US006634937B1

(12) United States Patent
Edwards et al.

(10) Patent No.: US 6,634,937 B1
(45) Date of Patent: Oct. 21, 2003

(54) CLAMPING SANDER

(76) Inventors: Toby Edwards, 2327 E. Aire Libre, Phoenix, AZ (US) 85022; Dan B. Pool, 12772 E. Turquoise, Phoenix, AZ (US) 85029

( * ) Notice: Subject to any disclaimer, the term of this patent is extended or adjusted under 35 U.S.C. 154(b) by 18 days.

(21) Appl. No.: 09/844,878

(22) Filed: Apr. 27, 2001

Related U.S. Application Data

(60) Provisional application No. 60/200,615, filed on Apr. 28, 2000.

(51) Int. Cl.[7] ..... B24D 15/00

(52) U.S. Cl. ..... 451/502; 451/524; 451/519; 451/520

(58) Field of Search ..... 451/344, 354, 451/356, 499, 502, 514, 517, 519, 520, 523, 524

(56) References Cited

U.S. PATENT DOCUMENTS 1,067,280 A * 7/1913 Smilovetz ..... 451/520
1,544,368 A * 6/1925 Brennan ..... 451/520
2,438,977 A * 4/1948 Rosemeyer ..... 451/520
2,848,850 A * 8/1958 Metoff ..... 451/344
4,475,317 A * 10/1984 Dicke ..... 451/356
5,628,679 A * 5/1997 Shiga ..... 451/508
5,902,176 A * 5/1999 Chen ..... 451/517

* cited by examiner

*Primary Examiner*—George Nguyen
*Assistant Examiner*—Anthony Ojini
(74) *Attorney, Agent, or Firm*—Robert A. Parsons; Michael W. Goltry; Parsons & Goltry

(57) ABSTRACT

A clamping sander for receiving and holding a sheet of sandpaper, including a chassis plate having an upper surface and a lower surface, and a clamp plate having an upper surface and a lower surface. The clamp plate is coupled to the chassis plate and movable between a released position, spaced from the chassis plate, and a clamped position with the lower surface engaging the upper surface of the chassis plate. A clamping mechanism is carried by the chassis plate and the clamp plate for moving the clamp plate between the released position and the clamped position.

13 Claims, 5 Drawing Sheets

CLAMPING SANDER

This application claims the benefit of Provisional Application Serial No. 60/200,615, filed Apr. 28, 2000.

FIELD OF THE INVENTION

This invention relates to sanding devices.

More particularly, the present invention relates to devices for retaining sandpaper during sanding procedures.

BACKGROUND OF THE INVENTION

Sandpaper is used in a wide variety of activities and on many materials. Woodworkers, auto body workers, painters etc. are among those who use sandpaper on wood, metal, wallboard and filler compounds just to list a few uses. Many types of surfaces, flat, curved, contoured etc, need sanding. The problem is that the human hand does not provide a uniform and unvarying force because of a tendency to change shape due to its highly articulate nature. Also, it is often very difficult to adequately maintain a secure hold on a piece of sandpaper.

To overcome these problems, sanding blocks are commonly used. A sanding block generally has a planar surface over which the sandpaper is placed. An individual gripping the block also grips the edges of the sandpaper thereby holding the sandpaper in place. While generally effective for sanding planar surfaces, irregular, contoured or curved surfaces are still commonly sanded by hand, as a sanding block is ineffectual. Thus, the problem of applying a uniform and consistent force is still a problem. Furthermore, holding the sandpaper in place is still problematic.

It would be highly advantageous, therefore, to remedy the foregoing and other deficiencies inherent in the prior art.

Accordingly, it is an object of the present invention to provide a sanding device for securely holding sandpaper while sanding.

Another object of the present invention to provide a sanding device which is capable of uniformly and consistently sanding surfaces.

And another object of the present invention to provide a sanding device which can be employed to sand planar surfaces, curved surfaces, contoured surfaces, corners, etc.

Still another object of the present invention to provide a sanding device in which sandpaper is easily installed.

SUMMARY OF THE INVENTION

Briefly, to achieve the desired objects of the instant invention in accordance with a preferred embodiment thereof, provided is a clamping sander for receiving and holding a sheet of sandpaper. The clamping sander includes a chassis plate having an upper surface and a lower surface, and a clamp plate having an upper surface and a lower surface. The clamp plate is coupled to the chassis plate and movable between a released position, spaced from the chassis plate, and a clamped position with the lower surface engaging the upper surface of the chassis plate. A clamping mechanism is carried by the chassis plate and the clamp plate for moving the clamp plate between the released position and the clamped position.

In a specific embodiment, the clamping mechanism includes a camming surface extending from the upper surface of the clamp plate adjacent an aperture formed therethrough. A post extends substantially perpendicularly from the upper surface of the chassis plate and is received through the aperture in the clamp plate. A grip is rotatably coupled to the post and includes a cam extending from a lower portion thereof, the cam engages the camming surface to force the grip away from the upper surface of the clamping plate, moving the clamping plate into the clamping position.

BRIEF DESCRIPTION OF THE DRAWINGS

Specific objects and advantages of the instant invention will become readily apparent to those skilled in the art from the following detailed description of a preferred embodiment thereof taken in conjunction with the drawings, in which.

DETAILED DESCRIPTION OF THE PREFERRED EMBODIMENT

Figure 1:
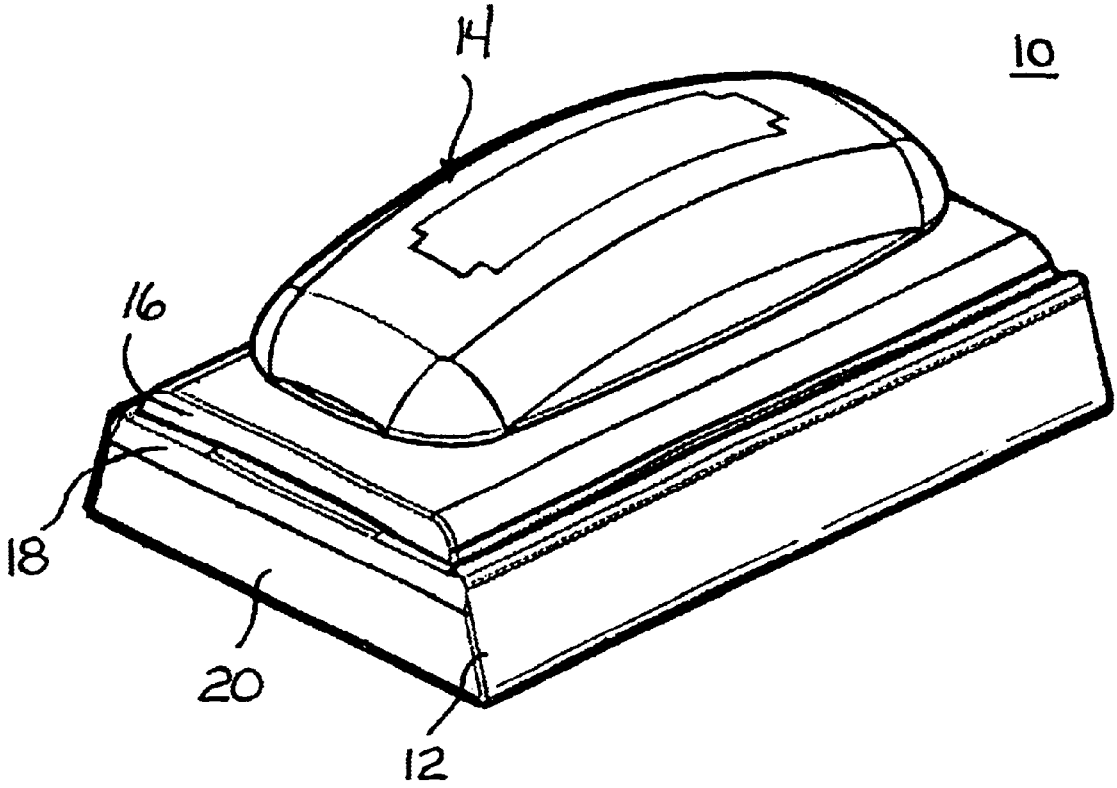
FIG. 1 is a perspective view of a clamping sander according to the present invention as it would appear holding sandpaper.

Turning now to the drawings in which like reference characters indicate corresponding elements throughout the several views, attention is first directed to FIG. 1 which illustrates a clamping sander generally designated 10. Sander 10 is illustrated with a sheet of sandpaper 12 securely held for sanding operations. Sander 10 includes a grip 14, which is employed to operate the clamping mechanism, a clamp plate 16 and a chassis plate 18. Opposing ends of sandpaper 12 are clamped between clamp plate 16 and chassis plate 18, with the body of the sandpaper in wrapping engagement with a base 20 coupled to chassis plate 18. Base 20 can be a flat rigid material for sanding planar materials, resilient material such as foam or sponge for sanding contoured surfaces, or a material having a contoured surface to match the contours of a surface to be sanded. In this manner, sandpaper can be accurately controlled and securely held.

Figure 2:
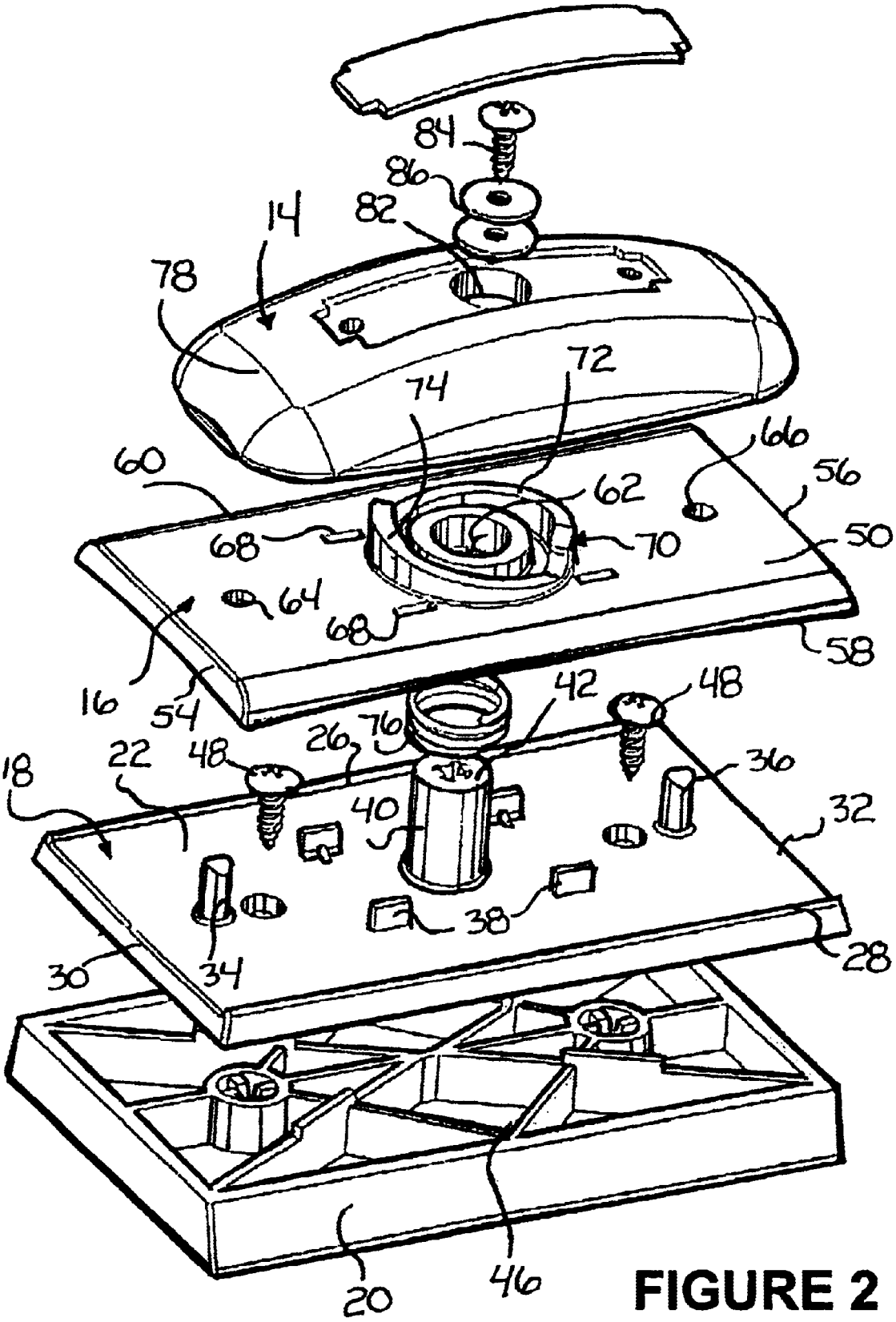
FIG. 2 is a top perspective view of the sander according to the present invention.
Figure 3:
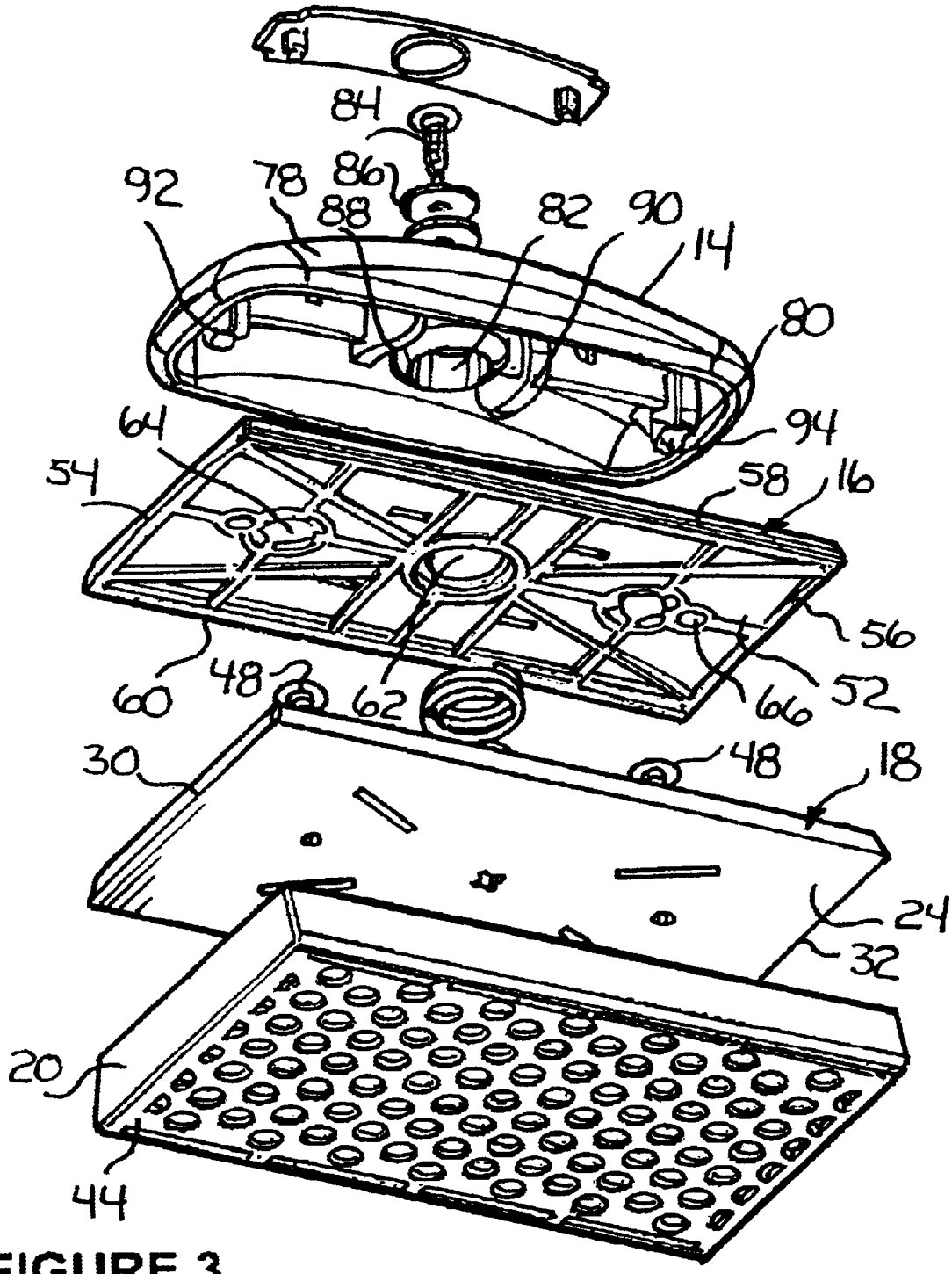
FIG. 3 is a bottom perspective view of the sander according to the present invention.

Referring now to FIGS. 2 and 3, sander 10 includes chassis plate 18 having an upper surface 22 and an opposing lower surface 24. Lower surface 24 is generally planar, and upper surface 22 has raised edges 26 and 28 on opposing sides, running from end 30 to end 32. A pair of locking tabs 34 and 36 extend from upper surface 22 intermediate raised edges 26 and 28 with tab 34 proximate end 30 and tab 36 proximate end 32. A plurality of loading stops 38 also extend from upper surface 22 spaced from raised edges 26 and 28 for abutting engagement by the edges of a sheet of sandpaper. A post 40 extends from upper surface 22 at a central location, terminating in end 42.

Base 20 has a lower surface 44 which, in this preferred embodiment, is generally planar, and an upper surface 46. Upper surface 46 of base 20 is fixed to lower surface 24 of chassis plate 18 by any convenient manner such as by fasteners, like clips staples etc., adhesives, etc. In this embodiment, a pair of screws 48 extend through chassis plate 18 into base 20.

Clamp plate 16 includes an upper surface 50, a lower surface 52, opposing ends 54 and 56 and opposing sides 58 and 60. Ends 54, 56 and sides 58, 60 preferably have a slight downward arch for purposes which will be described presently. Clamp plate 16 has a central aperture 62 through which post 40 is received, an aperture 64 proximate end 54 through which locking tab 34 extends and an aperture 66 proximate end 56 through which locking tab 36 extends. A plurality of apertures 68 are formed through clamping plate 16 aligned with and receiving the plurality of stops 38. Clamping plate 16 also includes a helical pressure converter 70. Converter 70 consists of a pair of opposing semi-circular camming surfaces 72 and 74 extending from upper surface 50 and encircling aperture 62. Clamp plate 16 is positioned adjacent upper surface 22 of chassis plate 18 with a biasing member 76 in the form of a compression spring carried by post 40 and captured between upper surface 22 of chassis plate 18 and lower surface 52 of clamp plate 16.

Grip 14 includes a grasping surface 78 formed by a contoured upper surface and sloped sides, and a lower portion 80. An aperture 82 is formed centrally through grip 14, through which post 40 is received. Grip 14 is rotatably secured to post 40 by a screw 84 and a pair of washers 86 which prevent screw 84 from loosening while allowing grip 14 to rotate. A pair of opposing semi-circular cams 88 and 90 extending from lower portion 80 and encircling aperture 82. Cams 88 and 90 engage camming surfaces 72 and 74 to force grip 14 away from upper surface 50 of clamping plate 16. Grip 14 is biased toward upper surface 50 of clamping plate 16 by biasing member 76. Biasing member 76 forces clamping plate 16 away from chassis plate 18 toward grip 14. Cams 88 and 90 and camming surfaces 72 and 74 interact to force clamping plate 16 against the bias of biasing member 76 toward chassis plate 18. Grip 14 also includes a pair of saddles 92 and 94 extending from lower portion 80 proximate opposing ends for receiving locking tabs 34 and 36.

Figure 4:
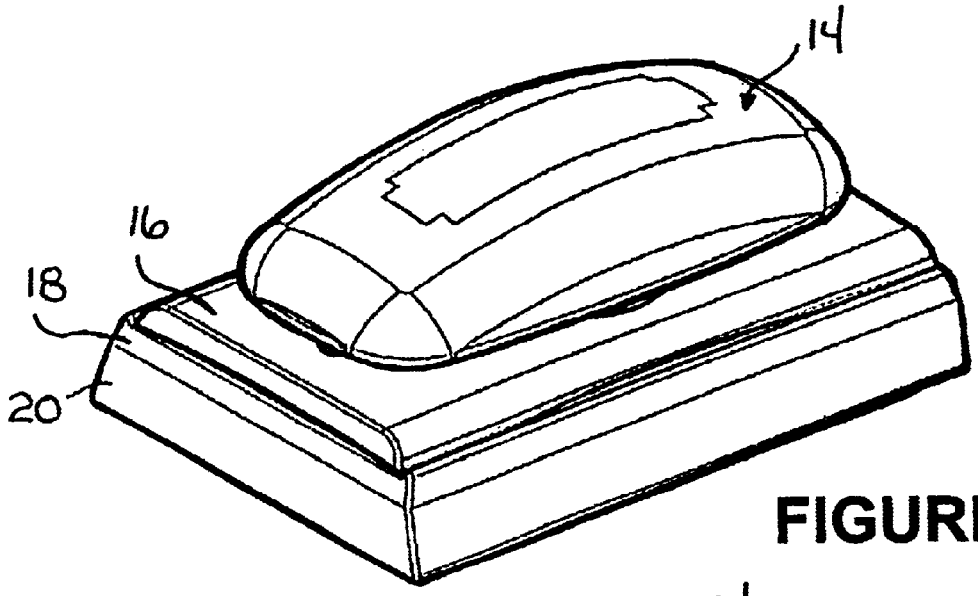
FIG. 4 is a perspective view of a clamping sander in the clamped position according to the present invention.
Figure 5:
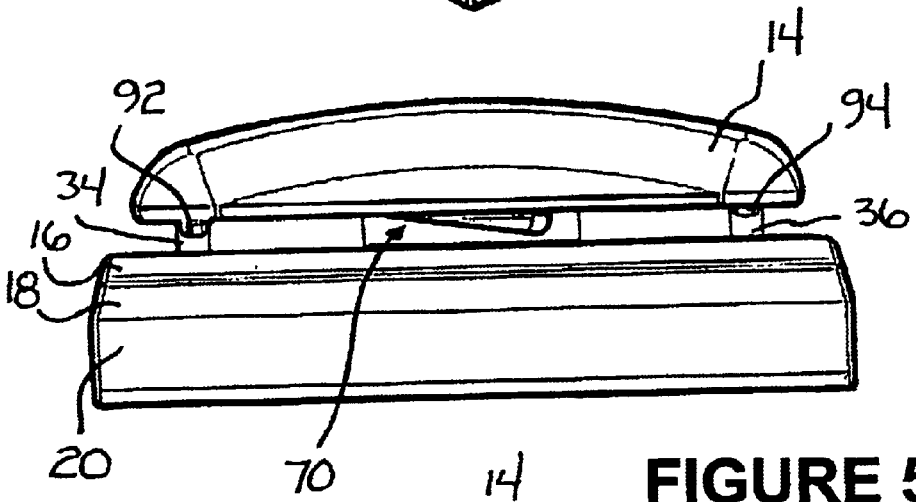
FIG. 5 is a side elevation of the sander of FIG. 4.
Figure 8:
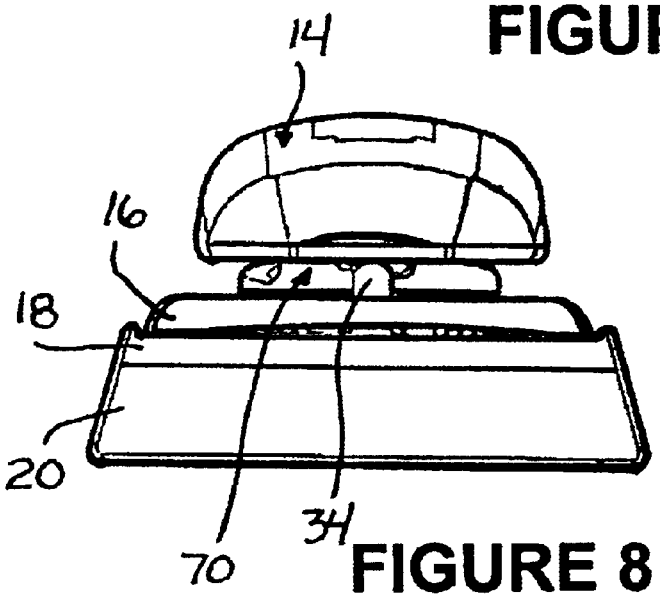
FIG. 8 is an end view of the sander of FIGS. 4 and 5.

Turning now to FIGS. 4, 5 and 8, sander 10 is shown in the closed or clamped position. In this position, grip 14 has been rotated so that cams 88 and 90 move to the highest portion of camming surfaces 72 and 74, forcing clamping plate 16 toward chassis plate 18. Tabs 34 and 36 are received in saddles 92 and 94, preventing rotation of grip 14, locking sander 10 into the closed position. In this position, the edges of the sandpaper are firmly captured between clamping plate 16 and raised edges 26 and 28 of chassis plate 18 (FIG. 1). The arced or bowed nature of ends 54, 56 and sides 58, 60 of clamping plate 16 permit different size grit sandpaper to be accommodated by sander 10. As the sandpaper thickens with increased grit size, the bow is flexed outward, becoming flattened. In this manner, a secure engagement is provided by the spring tension of the flexed material, while allowing sandpaper of different grits to be held.

Figure 6:
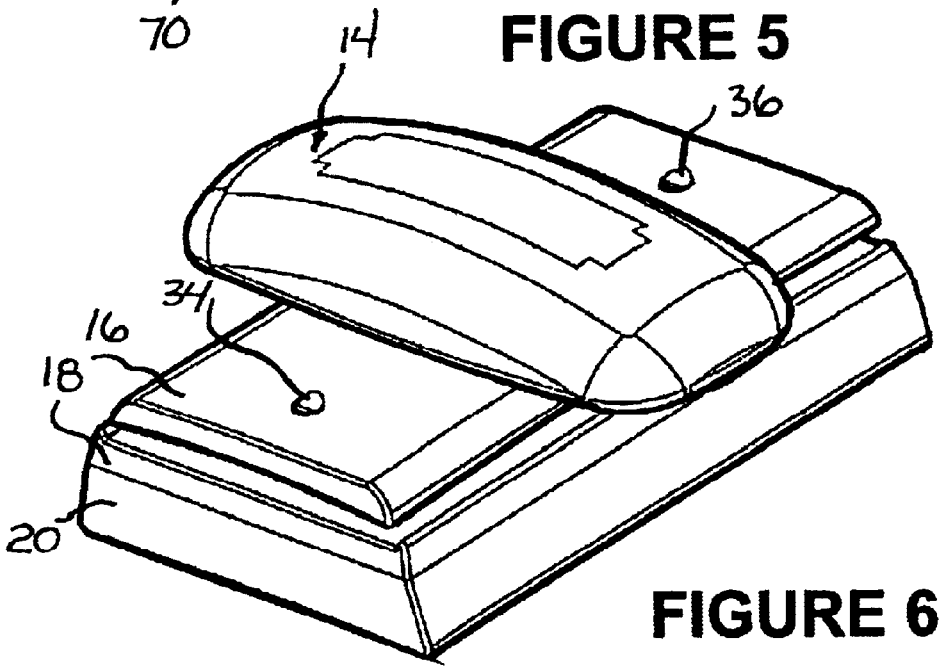
FIG. 6 is a perspective view of a clamping sander in the open position according to the present invention.
Figure 7:
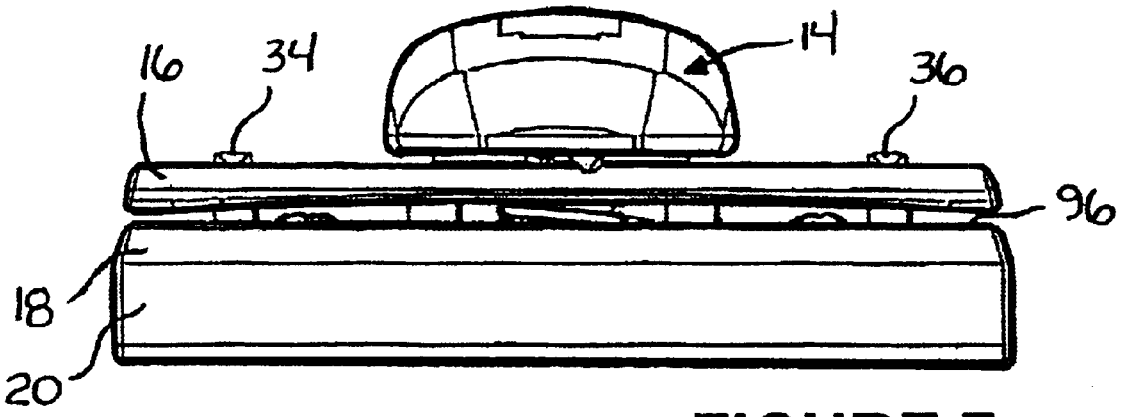
FIG. 7 is a side elevation of the sander of FIG. 6.
Figure 9:
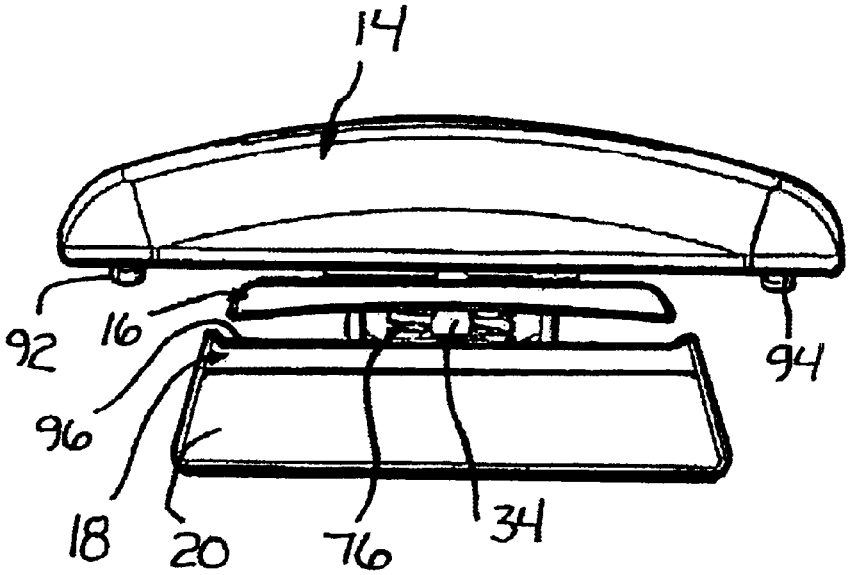
FIG. 9 is an end view of the sander of FIGS. 6 and 7.

Turning now to FIGS. 6, 7, and 9, sander 10 is shown in the open or unclamped position. In this position, grip 14 has been rotated so that cams 88 and 90 move to the lowest portion of camming surfaces 72 and 74, permitting biasing element 76 to force clamping plate 16 away from chassis plate 18 to provide a gap 96. The edges of a sheet of sandpaper are inserted into gap 96 until they are halted by stops 38. Grip 14 is then rotated into the closed or clamped position, firmly retaining the sandpaper in position.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A clamping sander for receiving and holding a sheet of sandpaper, the clamping sander comprising:

a chassis plate having an upper surface and a lower surface;

a clamp plate having an upper surface and a lower surface, the clamp plate being coupled to the chassis plate and movable between a released position spaced from the chassis plate and a clamped position with the lower surface engaging the upper surface of the chassis plate;

a grip coupled to the chassis plate for being grasped by an operator for using the clamping sander; and a clamping mechanism carried by the chassis plate and the clamp plate for moving the clamp plate between the released position and the clamped position, the clamping mechanism operated by rotation of the grip and including a camming surface extending from the upper surface of the clamp plate adjacent an aperture formed therethrough, a post extending substantially perpendicularly from the upper surface of the chassis plate and received through the aperture in the clamp plate, and the grip rotatably coupled to the post and including a cam extending from a lower portion thereof, the cam engaging the camming surface to force the grip away from the upper surface of the clamping plate, moving the clamping plate into the clamping position, the camming surface includes a pair of opposing semi-circular camming surfaces encircling the aperture in the clamp plate, and the cam includes a pair of opposing semi-circular cams riding on the camming surfaces.

2. A clamping sander as claimed in claim 1 wherein the clamping mechanism further includes a biasing member captured between the upper surface of the chassis plate and the lower surface of the clamp plate.

3. A clamping sander as claimed in claim 1 wherein the upper surface of the chassis plate has raised edges on opposing sides thereof.

4. A clamping sander as claimed in claim 3 wherein opposing edges of clamping plate are bowed to provide flexion thereof.

5. A clamping sander as claimed in claim 3 wherein the base is one of a flat rigid material for sanding planar materials, a resilient material for sanding contoured surfaces, and a material having a contoured surface to match the contours of a surface to be sanded.

6. A clamping sander as claimed in claim 1 further including a base coupled to the lower surface of the chassis plate.

7. A clamping sander for receiving and holding a sheet of sandpaper, the clamping sander comprising:

a chassis plate having an upper surface and a lower surface;

a clamp plate having an upper surface and a lower surface, the clamp plate being coupled to the chassis plate and movable between a released position spaced from the chassis plate and a clamped position with the lower surface engaging the upper surface of the chassis plate;

a grip coupled to the chassis plate for being grasped by an operator for using the clamping sander; and a clamping mechanism carried by the chassis plate and the clamp plate for moving the clamp plate between the released position and the clamped position, the clamping mechanism operated by rotation of the grip and including a camming surface extending from the upper surface of the clamp plate adjacent an aperture formed therethrough, a post extending substantially perpendicularly from the upper surface of the chassis plate and received through the aperture in the clamp plate, and the grip rotatably coupled to the Post and including a cam extending from a lower portion thereof, the cam engaging the camming surface to force the grip away from the upper surface of the clamping plate, moving the clamping plate into the clamping position;

the clamping mechanism further includes a locking tab extending from the upper surface of the chassis plate and received through apertures formed in the clamp plate, and a saddle extending from the lower portion of the grip for receiving the locking tab with the clamp plate in the clamping position.

8. A clamping sander for receiving and holding a sheet of sandpaper, the clamping sander comprising:

a chassis plate having an upper surface, a lower surface, and a post extending substantially perpendicularly from the upper surface;

a clamp plate having an upper surface, a lower surface, and an aperture formed therethrough, the clamp plate being coupled to the chassis plate and movable between a released position spaced from the chassis plate and a clamped position with the lower surface engaging the upper surface of the chassis plate;

a camming surface extending from the upper surface of the clamp plate adjacent the aperture formed therethrough, the camming surface includes a pair of opposing semi-circular camming surfaces encircling the aperture in the clamp plate;

a grip, for being grasped by an operator for using the clamping sander, rotatably coupled to an end of the post extending through the aperture in the clamp plate and including a cam extending from a lower portion thereof, the cam engaging the camming surface to force the grip away from the upper surface of the clamping plate, moving the clamping plate into the clamping position, the cam includes a pair of opposing semi-circular cams riding on the camming surfaces; and a biasing member captured between the upper surface of the chassis plate and the lower surface of the clamp plate.

9. A clamping sander as claimed in claim 8 further including:

a locking tab extending from the upper surface of the chassis plate and received through apertures formed in the clamp plate; and a saddle extending from the lower portion of the grip for receiving the locking tab with the clamp plate in the clamping position.

10. A clamping sander as claimed in claim 8 wherein the upper surface of the chassis plate has raised edges on opposing sides thereof.

11. A clamping sander as claimed in claim 10 wherein the opposing edges of clamping plate are bowed to provide flexion thereof.

12. A clamping sander as claimed in claim 8 further included a base coupled to the lower surface of the chassis.

13. A clamping sander as claimed in claim 12 wherein the base is one of a flat rigid material for sanding planar materials, a resilient material for sanding contoured surfaces, or a material having a contoured surface to match the contours of a surface to be sanded.

* * * * *